US008047635B2

(12) United States Patent
Okubo

(10) Patent No.: US 8,047,635 B2
(45) Date of Patent: Nov. 1, 2011

(54) LIQUID EJECTING HEAD AND LIQUID EJECTING DEVICE

(75) Inventor: Katsuhiro Okubo, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 443 days.

(21) Appl. No.: 12/367,418

(22) Filed: Feb. 6, 2009

(65) Prior Publication Data

US 2009/0195622 A1 Aug. 6, 2009

(30) Foreign Application Priority Data

Feb. 6, 2008 (JP) ..... 2008-026908
Sep. 29, 2008 (JP) ..... 2008-249842

(51) Int. Cl.
*B41J 2/045* (2006.01)
*B41J 2/05* (2006.01)

(52) U.S. Cl. ..... 347/68; 347/65; 347/71

(58) Field of Classification Search ..... None
See application file for complete search history.

(56) References Cited

FOREIGN PATENT DOCUMENTS

JP 2002-001953 A 1/2002
JP 2004-042559 A 2/2004
JP 2007-076093 A 3/2007

*Primary Examiner* — Matthew Luu
*Assistant Examiner* — Lisa Solomon
(74) *Attorney, Agent, or Firm* — Kilpatrick Townsend & Stockton LLP

(57) ABSTRACT

A liquid ejecting head includes a reservoir forming substrate provided with a reservoir serving as a common liquid chamber; in which at least a portion of a wall surface of the reservoir is an inclined surface, a lower side of the reservoir in a vertical direction is provided with a lower portion of which a width is wider than an upper portion of the reservoir in the vertical direction thanks to the inclined surface, a compliance portion which absorbs pressure of the reservoir is disposed at an area which faces the lower portion and has a shape corresponding to the lower portion, and the reservoir communicates with an upper portion of each of the pressure generating chambers in the vertical direction rather than a lower portion of each of pressure generating chambers.

7 Claims, 10 Drawing Sheets

LIQUID EJECTING HEAD AND LIQUID EJECTING DEVICE

BACKGROUND

1. Technical Field

The present invention relates to a liquid ejecting head and a liquid ejecting device which eject liquid from nozzle orifices thereof, and more particularly to an ink-jet recording head and an ink-jet recording device which ejects ink as the liquid.

2. Related Art

As an ink-jet recording head which is an example of a liquid ejecting head, for example, JP-A-2004-042559 (pages 6 to 8 and FIGS. 1-2) discloses a structure including an actuator unit provided with piezoelectric elements and pressure generating chambers, and a channel unit provided with a nozzle plate having nozzle orifices which discharge ink by communicating the pressure generating chambers and a reservoir-formed substrate provided with a reservoir serving as a common ink chamber of the pressure generating chambers.

JP-A-2007-76093 discloses an ink-jet head having a compliance substrate which is provided with a compliance portion which deforms by change of inside pressure of a reservoir at the bottom side of a reservoir-formed substrate.

JP-A-2002-1953 discloses a structure of an ink-jet recording head in which a width of channels is gradually decreased in a direction in which liquid flows.

The reservoir of the ink-jet recording head is structured in a manner of preventing bubbles from staying in the reservoir by increasing speed of flow of liquid at an area where bubbles are likely to be generated by decreasing a width of the reservoir in a direction which is perpendicular to a parallel arrangement direction in which the pressure generating chambers of the reservoir are arranged since bubbles are more actively generated as the speed of flow of ink is lowered.

However, the change of inside pressure of each of the pressure chambers is absorbed by a compliance portion defined by a width of an area which communicates with the pressure generating chambers of the reservoir in a direction which is perpendicular to the parallel arrangement direction of the pressure generating chambers. Accordingly, if the width in the direction perpendicular to the parallel arrangement direction of the pressure generating chambers of the reservoir is decreased, it is impossible for the pressure generating chambers communicating with the area having the decreased width to obtain good ink discharge characteristic.

The above-mentioned problems also encounters in the structure which is disclosed in JP-A-2007-76093 and in which the compliance portion is disposed at the bottom side of the reservoir formed substrate. JP-A-2002-1953 discloses the ink-jet recording head having the structure in which the width of the channel is gradually decreased in the liquid flowing direction but never mention about the compliance portion and the bubbles so that it was impossible to solve the above-mentioned problems.

The above-mentioned problems encounter in liquid ejecting heads which eject liquid other than ink besides the ink-jet recording head.

SUMMARY

An object of some aspects of the invention is that it provides a liquid ejecting head and a liquid ejecting device having improved liquid ejecting characteristic.

According to one aspect of the invention, there is provided a liquid ejecting head including: a channel forming substrate in which a plurality of pressure generating chambers communicating with nozzle orifices which eject liquid are arranged in a single direction; a reservoir forming substrate provided with a reservoir serving as a common liquid chamber communicating the plurality of pressure generating chambers in a manner such that the reservoir is disposed over the plurality of pressure generating chambers; and a pressure generating unit which causes pressure change with respect the plurality of pressure generating chambers, in which at least a portion of a wall surface of the reservoir is an inclined surface, a lower side of the reservoir in a vertical direction becomes a lower portion of which a width is wider than an upper side of the reservoir in the vertical direction by the inclined surface, a compliance portion which absorbs pressure of the reservoir is disposed at an area which faces the lower portion and has a shape corresponding to the lower portion, and the reservoir communicates with an upper portion of each of the pressure generating chambers in the vertical direction rather than the lower portion.

Further, the upper side and the lower side in the vertical direction need not always be an upper side and a lower side in the vertical direction. It is sufficient that the upper side and the lower side in the vertical direction be an upper side and a lower side in the vertical direction at least while ejecting liquid.

In the aspect, it is possible to increase a width of the compliance portion by the lower portion formed by the inclined surface of the reservoir, and it is possible to improve the liquid ejecting characteristic by enhancing compliance of the pressure generating chamber. Further, it is possible to equalize the liquid ejecting characteristic by equalizing the compliances of the plurality of pressure generating chambers. In addition, it is possible to prevent bubbles from staying in the lower portion of the reservoir by making the wall surface of the lower portion of the reservoir with the inclined surface. That is, thanks to the inclined wall surface of the lower portion, the bubbles can easily float up in the vertical direction and be discharged and therefore it is possible to improve the liquid ejection characteristic.

Here, it is preferable that the inclined surface be a surface inclining toward a communicating side of the pressure generating chambers. With this structure, i.e. with the inclined surface inclining toward the communicating side of the pressure generating chambers, it is possible for the bubbles to be easily discharged toward the pressure generating chambers along the inclined surface.

It is preferable that the inclined surface be disposed at the lower side of the reservoir in the vertical direction, and a vertical surface which directly and continuously extends from the inclined surface in the vertical direction be disposed at an upper side of the inclined surface. With this structure, since the inclined surface is directly connected to the vertical surface, it is possible to make the bubbles, which are raised to the upper side of the reservoir in the vertical direction along the inclined surface, go upward toward a more upper side of the reservoir in the vertical direction along the vertical surface, and therefore it is possible to improve bubble discharge characteristic.

It is preferable that a width of the upper portion of the reservoir in a direction which perpendicularly intersects the single direction and the vertical direction gradually decrease toward a distal portion from a liquid take-in portion of the reservoir at an area which is distanced in the single direction from an area which communicates the liquid take-in portion through which liquid is introduced into the reservoir, and the inclined surface be disposed at least at an area of the reservoir which corresponds to a gradually decreasing portion. With this structure, thanks to the gradually decreasing area, the flow of the liquid in the reservoir becomes faster and therefore it is possible to prevent the bubbles from staying. Further, it is possible to equalize the liquid ejection characteristic by equalizing the compliances of the plurality of pressure generating chambers by preventing the compliances of the pressure generating chambers from being lowered by the gradually decreasing area.

It is preferable that the nozzle orifices be disposed on the same side as the reservoir with respect to the pressure generating chambers. With this structure, it is possible to eject liquid from the lower side of the vertical direction.

It is preferable that the reservoir forming substrate be formed as a single member. With this structure, it is possible to reduce the cost by decreasing the number of parts.

According to another aspect of the invention, there is provided a liquid ejecting device including the above-mentioned liquid ejecting head.

With this structure, it is possible to realize the liquid ejecting device having improved print quality which is accomplished by improving and equalizing the liquid ejecting characteristic.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described with reference to the accompanying drawings.

First embodiment

Figure 1:
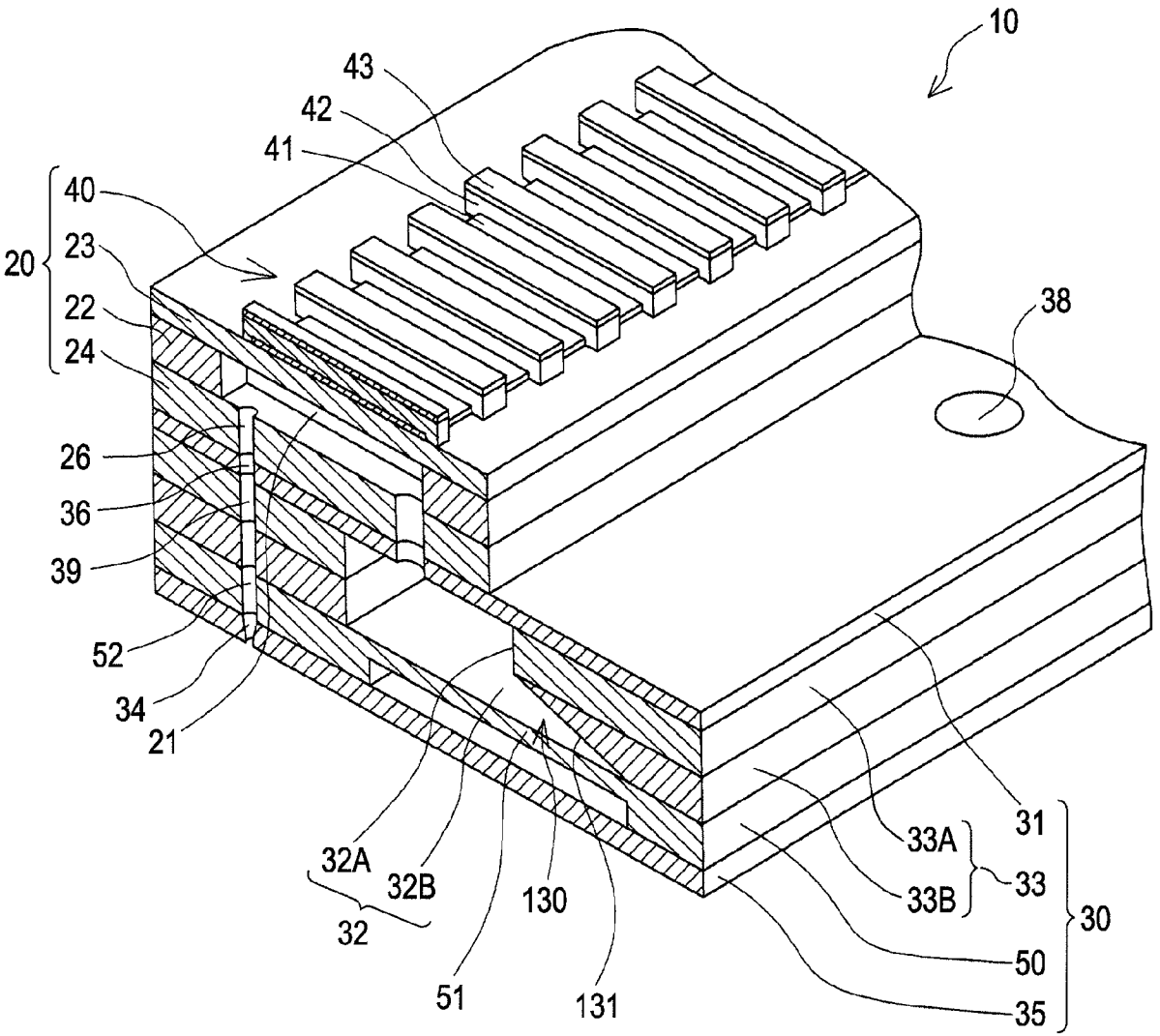
FIG. 1 is a perspective view illustrating a recording head according to a first embodiment of the invention, in which the main part is cut away.
Figure 2:
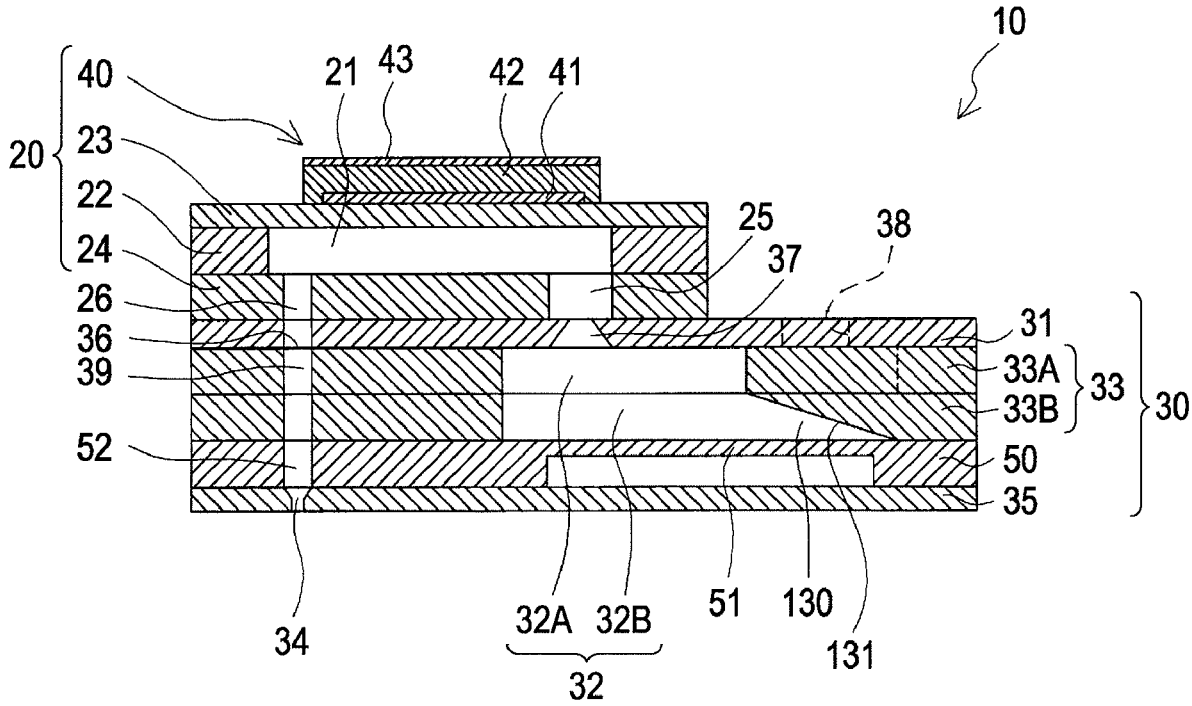
FIG. 2 is a sectional view illustrating main part of the recording head according to the first embodiment.
Figure 3:
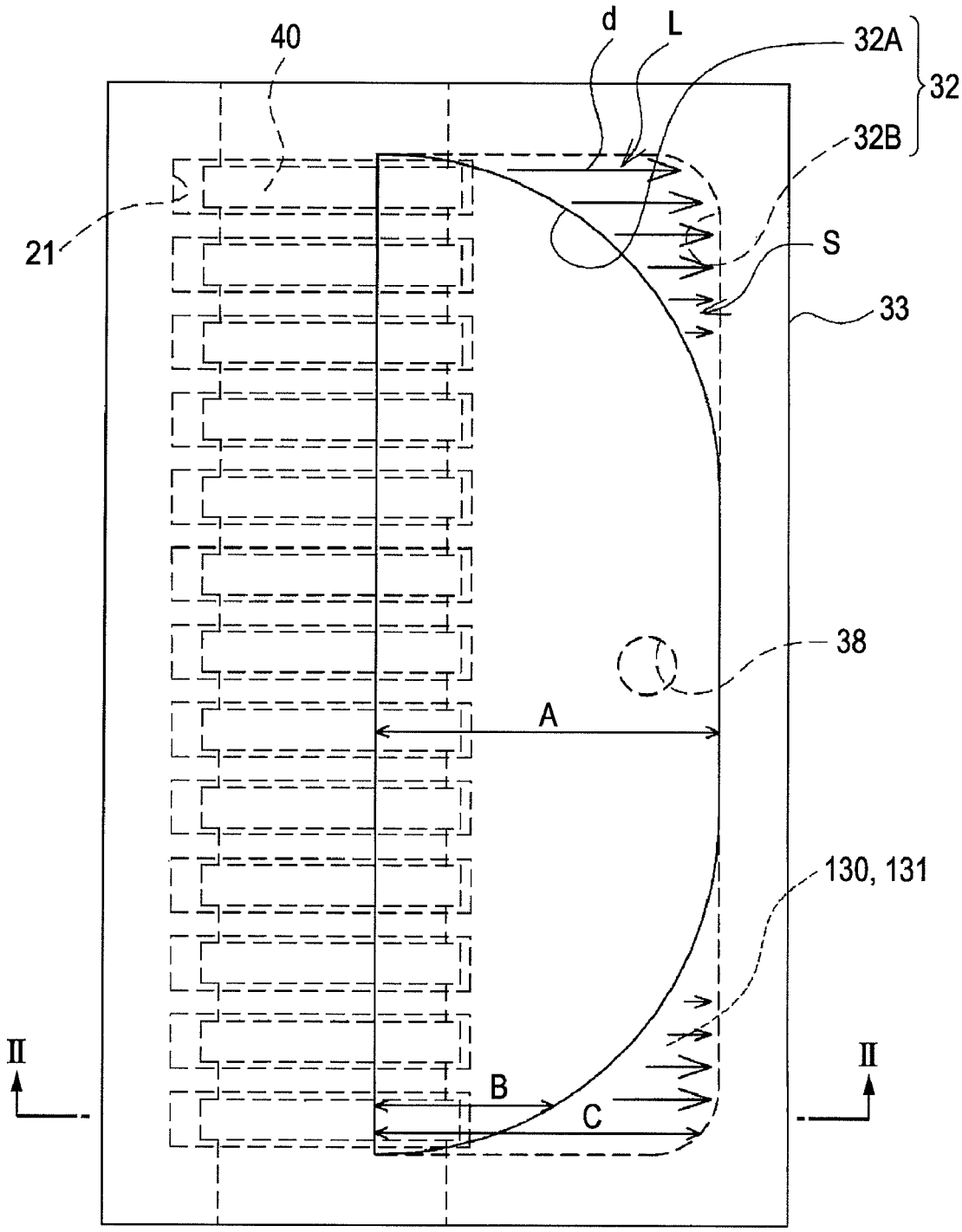
FIG. 3 is a plan view illustrating the main part of the recording head according to the first embodiment.

FIG. 1 is a perspective view illustrating an ink-jet recording head which is an example of a liquid ejecting head according to a first embodiment of the invention, FIG. 2 is a cross-sectional view illustrating the ink-jet recording head, and FIG. 3 is a plan view illustrating main part of the ink-jet recording head.

As shown in the drawings, an ink-jet recording head 10 according to this embodiment includes an actuator unit 20 and a channel unit 30 to which the actuator unit 20 is fixed.

The actuator unit 20 is an actuator device provided with piezoelectric elements 40. The actuator unit 20 includes a channel forming substrate 22 provided with pressure generating chambers 21, a vibrating plate 23 disposed on one side of the channel forming substrate 22, and a pressure generating chamber bottom plate 24 provided on the other side of the channel forming substrate 22.

The channel forming substrate 22 is a ceramic substrate having a thickness of 150 μm and made of alumina $Al_2O_3$ or zirconia $ZrO_2$. In this embodiment, a plurality of pressure generating chambers 21 is arranged in a widthwise direction. The vibrating plate 23, which is a thin plate having a thickness of 10 to 12 μm and made of stainless steel (SUS), is fixed on one-side surface of the channel forming substrate 22, and one-sides of the pressure generating chambers 21 are sealed by the vibrating plate 23.

The pressure generating chamber bottom substrate 24 is fixed to the other-side surface of the channel forming substrate 22 and seals the other sides of the pressure generating chambers 21. The pressure generating chamber bottom substrate 24 has a supply communication hole 25 which is disposed near one-side end portions of the pressure generating chambers 21 and which communicates with the pressure generating chambers 21 and a reservoir which will be described later, and a nozzle communication hole 26 which is disposed near the other-side ends of the pressure generating chambers 21 in a long-size direction and which communicates with nozzle orifices 34 which will be described later.

The piezoelectric elements 40 are disposed at areas facing the pressure generating chambers 21 on the vibrating plate 23, respectively.

Each of the piezoelectric elements 40 is composed of a lower electrode film 41 disposed on the vibrating plate 23, a piezoelectric layer 42, and an upper electrode films 43 disposed on the piezoelectric layer 42. The piezoelectric layers 42 of the piezoelectric elements 40 may be formed in a discrete manner so as to correspond to pressure generating chambers 21, respectively. The upper electrode films 43 are disposed on the respective piezoelectric layers 42. The piezoelectric layers 42 are formed by attaching a green sheet of a piezoelectric material to a lower electrode film with an adhesive or printing the piezoelectric material. The lower electrode film 41 is formed all over the piezoelectric layers 42 arranged in parallel with each other, is a common electrode for all of the piezoelectric elements 40, and functions as a portion of the vibrating plate. The lower electrode film 41 may be formed in a discrete way so as to correspond to the respective piezoelectric layers 42.

The channel forming substrate 22, the vibrating plate 23, and the pressure generating chamber bottom plate 24 which are layers of the actuator unit 20 are formed in the following method. That is, each of these layers is formed through a method in which a green sheet of a clayey ceramic material is formed to a predetermined thickness, the pressure generating chambers 21 are punctured, and then the green sheet is laminated on another sheet and then sintered. Through the above-mentioned method, the channel forming substrate 22 is integrally formed without using the adhesive. After that, the piezoelectric elements 40 are formed on the vibrating plate 23.

The channel unit 30 is composed of a liquid supply hole forming substrate 31 bonded to the pressure generating chamber bottom plate 24 of the actuator unit 20, a reservoir forming substrate 33 provided with a reservoir 32 serving as a common ink chamber for the plurality of pressure generating chambers 21, a compliance substrate 50 disposed on one side of the reservoir forming substrate 33 on the opposite side of the liquid supply hole forming substrate 31, and a nozzle plate 35 provided with nozzle orifices 34.

The liquid supply hole forming substrate 31 is a thin plate having a thickness of 60 μm and made of stainless steel (SUS). The liquid supply hole forming substrate 31 is provided with a nozzle communication hole 36 connected between the nozzle orifices 34 and the pressure generating chambers 21, a liquid supply hole 37 connected between the reservoir 32 and the pressure generating chambers 21, which are punctured, along with the supply communication holes 25, and a liquid take-in hole 38 which communicates with the reservoir 32 and supplies ink supplied from an external ink tank to the reservoir 32. The liquid supply hole 37 and the liquid take-in hole 38 are disposed so as to communicate with both ends of the reservoir 32, respectively, in a lengthwise direction of the pressure generating chambers 21, i.e. in a direction which is perpendicular to a direction in which the pressure generating chambers 21 are arranged in parallel with one another. In this embodiment, one liquid take-in hole 38 is disposed so as to communicate with a middle portion of the reservoir 32 in the parallel arrangement direction of the pressure generating chambers 21.

The reservoir forming substrate 33 is composed of a corrosive-resistant plate member, such as a stainless steel plate member, having a thickness of 150 μm, which is suitable for ink channels (liquid channels). The reservoir forming substrate 33 is further composed of the reservoir 32 which receives the ink from the external ink tank (not shown) and supplies the ink to the pressure generating chambers 21, and a nozzle communication hole 39 which links the pressure generating chambers 21 with the nozzle orifices 34.

The reservoir 32 is disposed over a way across the plurality of pressure generating chambers 21. That is, the reservoir 32 is formed across the pressure generating chambers 21 in a single direction which is the parallel arrangement direction of the pressure generating chambers 21. A portion of a wall surface of the reservoir 32 is an inclined surface 131 which inclines toward the compliance substrate 50, forming a width-increased portion 130 of which a width increases as it becomes closer to the compliance substrate 50. The reservoir 32 is composed of a first reservoir 32A, which is an upper portion of the reservoir, and a second reservoir 32B which is a lower portion of the reservoir. A side surface of the first reservoir 32A to which the inclined surface 131 is not provided is disposed at the liquid supply hole forming substrate 31 side which is composed of only a vertical surface and the second reservoir 32B is disposed at the lower side of the first reservoir 32A in the vertical direction, i.e. at the compliance substrate 50 side, and provided with a wall surface having an inclined surface 131. The "vertical direction" is a direction in an actual use time when ink is discharged from the nozzle orifice 34 of the ink-jet recording head 10.

The first reservoir 32A has a shape in which a width thereof in a direction, which is perpendicular to the parallel arrangement direction of the pressure generating chambers 21, i.e. a width in a long-size direction of the pressure generating chambers 21 (also called "width in a short-size direction of the reservoir 32"), gradually decreases toward an area distanced from an area communicating with the liquid take-in hole 38 in a direction (hereinafter, referred to as "long-size direction of the reservoir 32"), which is the parallel arrangement direction of the pressure generating chambers 21 (piezoelectric elements 40). That is, the first reservoir 32A is provided in a manner such that the width of the first reservoir in the short-size direction gradually decreases from a middle portion toward both end portions of the first reservoir in the long-size direction in which the middle portion in the long-size direction communicates with the liquid take-in hole 38. Accordingly, the length in the long-size direction gradually increases along a way from an area communicating with the liquid take-in hole 38 to an area communicating with the liquid supply hole 37.

In this manner, since the first reservoir 32A is structured in a manner such that the width of the first reservoir in the short-size direction gradually decreases at both end portions in the long-size direction in comparison with the middle portion communicating with the liquid take-in hole 38 in the long-size direction, it is possible to prevent bubbles from staying in the reservoir by increasing the speed of flow of the ink (liquid) which flows at both end portions (in the long-size direction) which are far from the liquid take-in hole 38.

The second reservoir 32B is disposed on the lower side of the first reservoir 32A in the vertical direction so as to communicate with a bottom surface of the first reservoir 32A. Further, the second reservoir 32B has the width-increased portion 130, of which a width in the direction which is perpendicular to the parallel arrangement direction of the pressure generating chambers 21 (the width in the short-size direction of the reservoir 32) is larger than that of the first reservoir 32A at an area distanced from the liquid take-in hole 38 in the parallel arrangement direction of the pressure generating chambers 21. The width-increased portion 130 is formed by the inclined surface 131. That is, the second reservoir 32B is formed in a manner such that the width of the second reservoir 32B in the short-size direction is equal at the middle portion, which communicates with the liquid take-in hole 38, and at both end portions of the second reservoir 32B in the long-size direction. At both end portions of the second reservoir in the long-size direction, the width-increased portion 130, of which the width in the short-size direction is larger than that of the liquid take-in hole 38 of the first reservoir 32A, is formed by the inclined surface 131.

That is, as shown in FIG. 3, the inclined surface 131 of this embodiment inclines toward the liquid supply hole 37 which communicates with the pressure generating chambers 21, i.e. in the short-size direction of the reservoir 32 (direction indicated by an arrow d of FIG. 3). In this embodiment, the width-increased portion 130 of the reservoir 32 has only the inclined surface 131. That is, the inclined surface 131 of the second reservoir 32B is directly connected to the vertical surface of the side of the first reservoir 32A. The phrases "the inclined surface is directly connected to the vertical" means that no other surfaces intervene between the inclined surface 131 and the vertical surface (of first reservoir 32A). That is, a horizontal surface which is perpendicular to the vertical surface is not disposed between the inclined surface 131 and the vertical surface and an edge of the inclined surface 131, and an edge of the vertical surface are a shared edge.

Figure 4A:
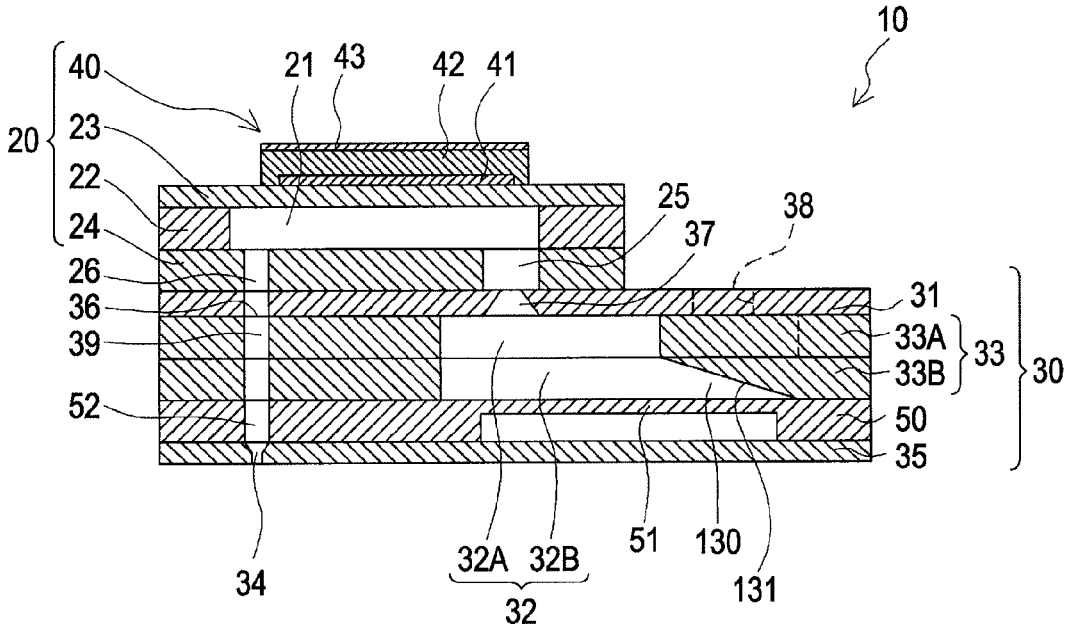
FIG. 4 is a cross-sectional view illustrating the main part of the recording head according to the first embodiment of the invention.
Figure 4B:
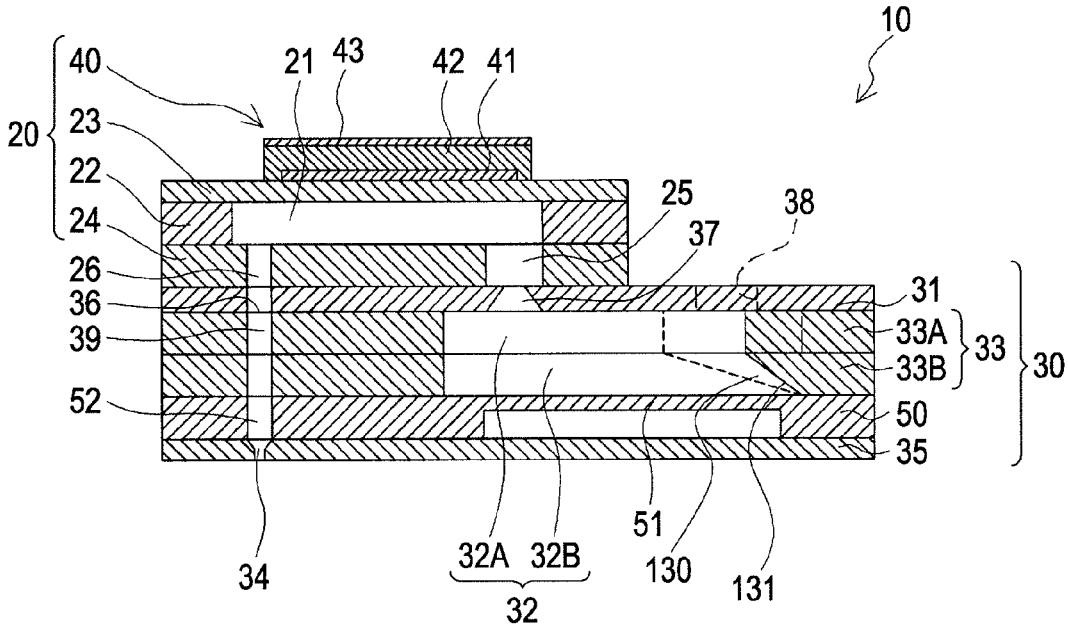

The inclined surface 131 is structured such that an inclination angle of the inclined surface 131 changes according to the width of the width-increased portion 130 of which the width is larger than that of the first reservoir 32A, and the width-increased portion 130 can be formed only by the inclined surface 131. That is, at a distal area L (see FIG. 3) of the width-increased portion 130 which is far from the liquid take-in hole 38, as shown in FIG. 4A, since the width of the width-increased portion 130 is large, the inclination angle of the inclined surface 131 (an angle with respect to the vertical surface) is also large. On the other hand, as shown in FIG. 4B, at a proximal area S (see FIG. 3) of the width-increased portion 130 which is closer to the liquid take-in hole 38, since the width of the width-increased portion 130 is small, the inclination angle of the inclined surface 131 (an angle with respect to the vertical surface) is small. In this manner, it is possible to form the width-increased portion 130 only by the inclined surface 131 by changing the inclination angle of the inclined surface 131 according to the desired width-increased portion 130.

Figure 5A:
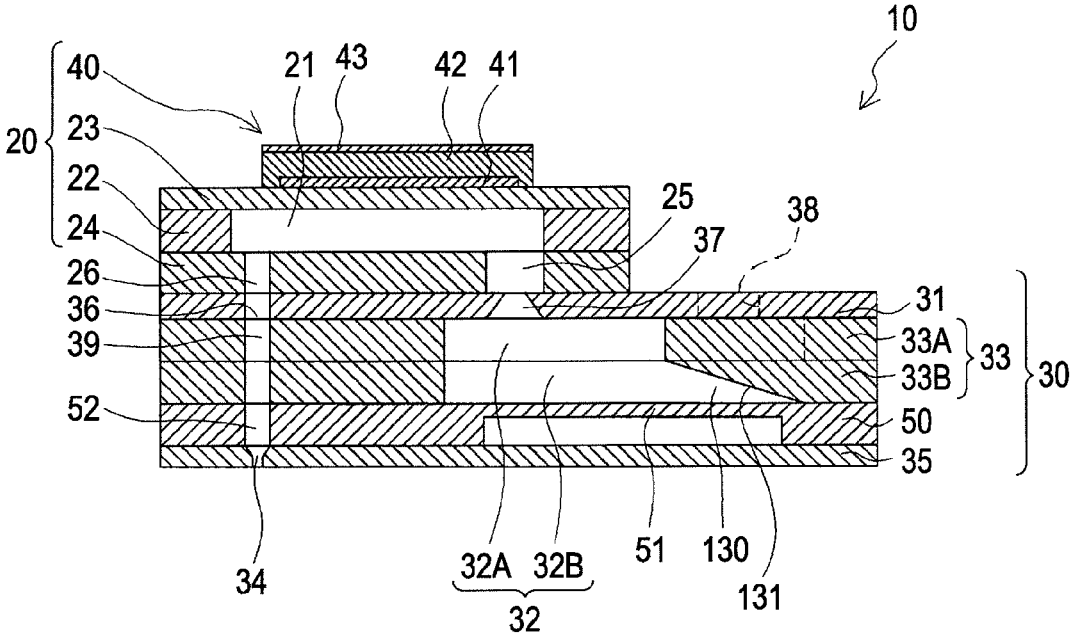
FIG. 5 is a cross-sectional view illustrating main part of a modification of the recording head according to the first embodiment.
Figure 5B:
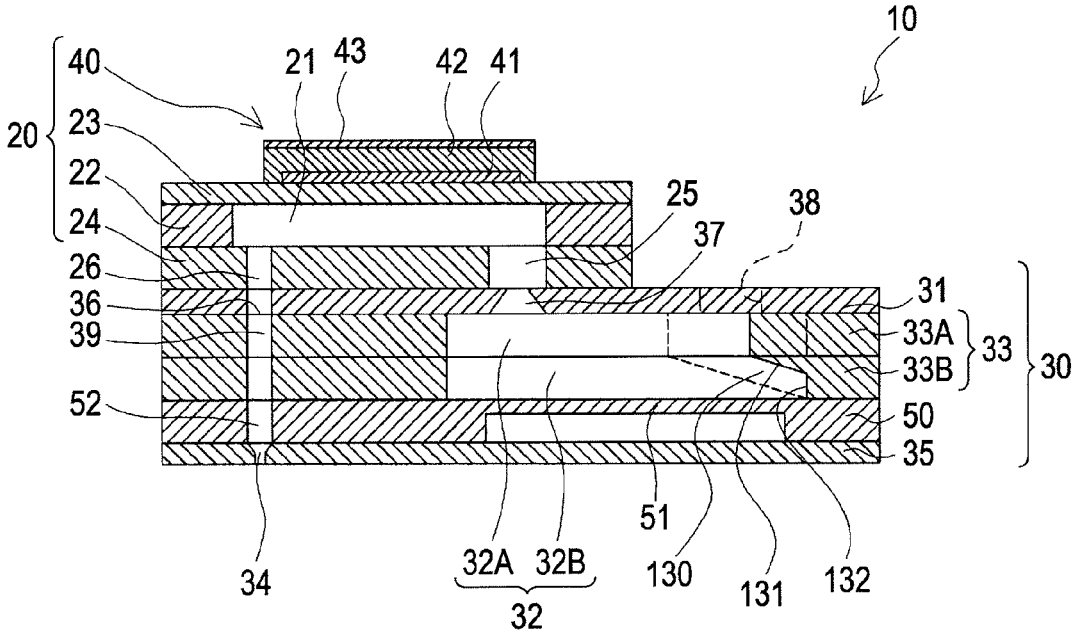

Alternatively, the inclination surface 131 may always maintain the same inclination angle. In this case, at the area L (see FIG. 3) at which the width of the width-increased portion 130 is large, as shown in FIG. 5A, the inclination surface has the same inclination angle as the inclined surface shown in FIG. 4A, but, as shown in FIG. 5B, at the area S (see FIG. 3) at which the width of the width-increased portion 130 is small, the wall surface of the second reservoir 32B is provided with the inclined surface 131 having the same inclination angle as that of FIG. 5A and the vertical surface 132 may be disposed at a more lower side than the inclined surface 131 in the vertical direction. As shown in FIG. 5B, it is possible to directly connect the inclined surface 131 to the wall surface of the first reservoir 32A, and therefore it is possible to improve bubble discharge characteristic of which details will be described later by providing the vertical surfaced 132 at the lower side of the inclined surface 131 in the vertical direction.

In the example shown in FIG. 5B, the vertical surface 132 is disposed at the lower side of the inclined surface 131 in the vertical direction, but the invention is not limited thereto. That is, conversely, the vertical surface 132 may be disposed at an upper side of the inclined surface 131 in the vertical direction. In the latter case, the vertical surface 132 of the second reservoir 32B also can be called the wall surface of the first reservoir 32A, it can be referred such that the depth of the second reservoir 32B becomes gradually shallower with the distance from the liquid take-in hole 38.

Figure 6:
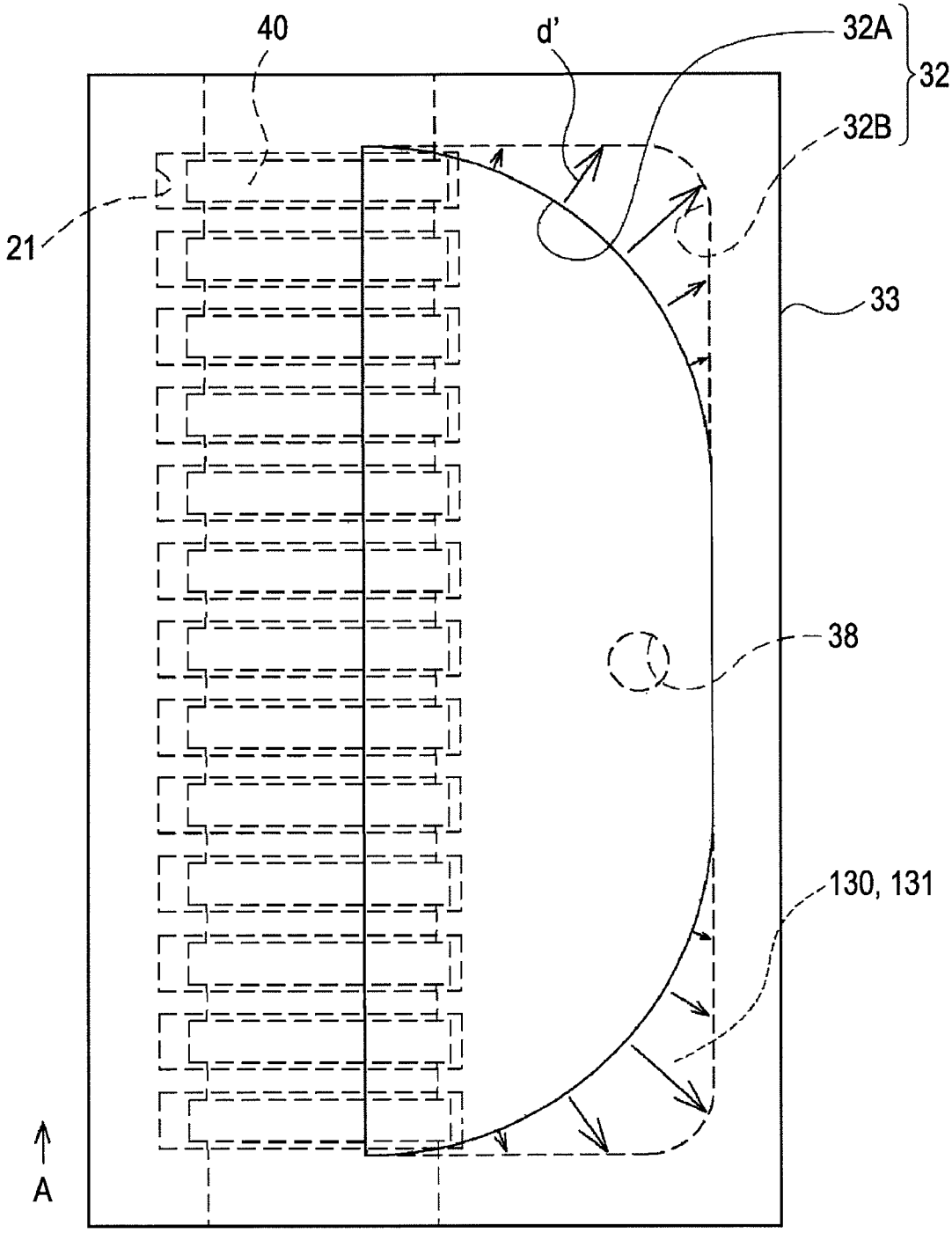
FIG. 6 is a plan view illustrating the main part of the modification of the recording head according to the first embodiment.

Further, the inclined surface 131 is not limited to a structure in which it inclines toward the pressure generating chambers 21 side. For example, as indicated by an arrow d' of FIG. 6, the inclination directions with respect to the first reservoir 32A may be different. That is, the inclined surface 131 may be formed in a radial fashion from the first reservoir 32A. The width-increased portion 130 which is a portion of a corn shape is formed by the inclined surface 131. However, as shown in FIG. 3, the structure in which the inclined surface 131 inclines in a manner such that the ink flows toward the pressure generating chambers 21 can improve the bubble discharge characteristic.

The compliance substrate 50 seals the bottom face of the reservoir 32 (the second reservoir 32B) by being bonded to a surface of the reservoir forming substrate 33 which is the opposite side surface of the liquid supply hole forming substrate 31. Since an area of the compliance substrate 50 which faces the second reservoir 32B and has a shape corresponding to the second reservoir 32B is formed thinner than other areas, this area becomes the compliance portion 51 which deforms according the pressure change of the reservoir 32.

With this structure, the compliance portion 51 is structured in a manner such that the width A (in the short-size direction) of the middle portion of the reservoir in the long-size direction, which communicates with the liquid take-in hole 38 of the reservoir 32, and the width C (in the short-size direction) of both end portions of the reservoir 32 in the long-size direction are equal to each other.

Accordingly, in the pressure generating chambers 21 which are arranged in parallel with one another, the compliance portion 51 can impart uniform compliance to an area near the liquid take-in hole 38 of the reservoir, i.e. the pressure generating chamber 21 at a midway position of the parallel arrangement direction, and to an area far from the liquid take-in hole 38 of the reservoir 32. That is, the compliance portion 51 imparts uniform compliance to the pressure generating chambers 21 disposed at both end portions of the parallel arrangement direction and the pressure generating chamber 21 disposed at the middle portion of the parallel arrangement direction. Further, the compliance portion 51 can improve the ink discharge characteristic of the pressure generating chambers 21 disposed at both end portions in the parallel arrangement direction, and also makes the plurality of nozzle orifices 34 discharge ink with the uniform ink discharge characteristic. Incidentally, in the case in which the reservoir 32 is composed of only the first reservoir 32A, the width B (in the short-size direction) of the reservoir 32 at both end portions of the reservoir 32 in the long-size direction is smaller than the width A of the middle portion of the reservoir, so that it is impossible to impart sufficient compliance to the pressure generating chambers 21 disposed at both end portions in the parallel arrangement direction and therefore the discharge characteristic of ink discharged via the pressure generating chambers 21 disposed at both end portions in the parallel arrangement direction deteriorates.

Since the width of the second reservoir 32B in the short-size direction becomes relatively large in comparison with the first reservoir 32A owing to the width-increased portion 130, the speed of the ink which flows through the width-increased portion 130 is lowered and therefore bubbles are likely to stay. However, since the second reservoir 32B is disposed at the lower side of the first reservoir 32A in the vertical direction, the bubbles staying inside the reservoir are raised to the first reservoir 32A side by buoyant force and can be discharged from the nozzle orifices 34 by the ink which flows through the first reservoir 32A. That is, in this embodiment, the first reservoir 32A and the second reservoir 32B disposed at the lower side of the first reservoir 32A in the vertical direction are provided as the reservoir, and the second reservoir 32B is provided with the width-increased portion 130 of which the with in the short-size direction is larger than that of the first reservoir 32A. Accordingly, it is possible to improve and equalize the ink discharge characteristic and to improve the bubble discharge characteristic.

Further, the width-increased portion 130 of the reservoir 32 is formed by the inclined surface 131. That is, the wall surface of the with-increased portion 130 is the inclined surface 131. With this structure, it is possible to easily raise the bubbles staying inside the width-increased portion 130 to a position of the first reservoir 32A by virtue of the inclined surface 131 and the buoyant force, and therefore it is possible to improve the bubble discharge characteristic. In this embodiment, the inclined surface 131 inclines in a direction in which the ink flows. That is the inclined surface 131 inclines toward a communicating side of each of the pressure generating chambers 21 i.e. toward the liquid supply hole 37 side. With this structure, it is possible to incline the inclined surface 131 in the ink flowing direction and to improve the bubble discharge characteristic of the reservoir 32.

Figure 7:
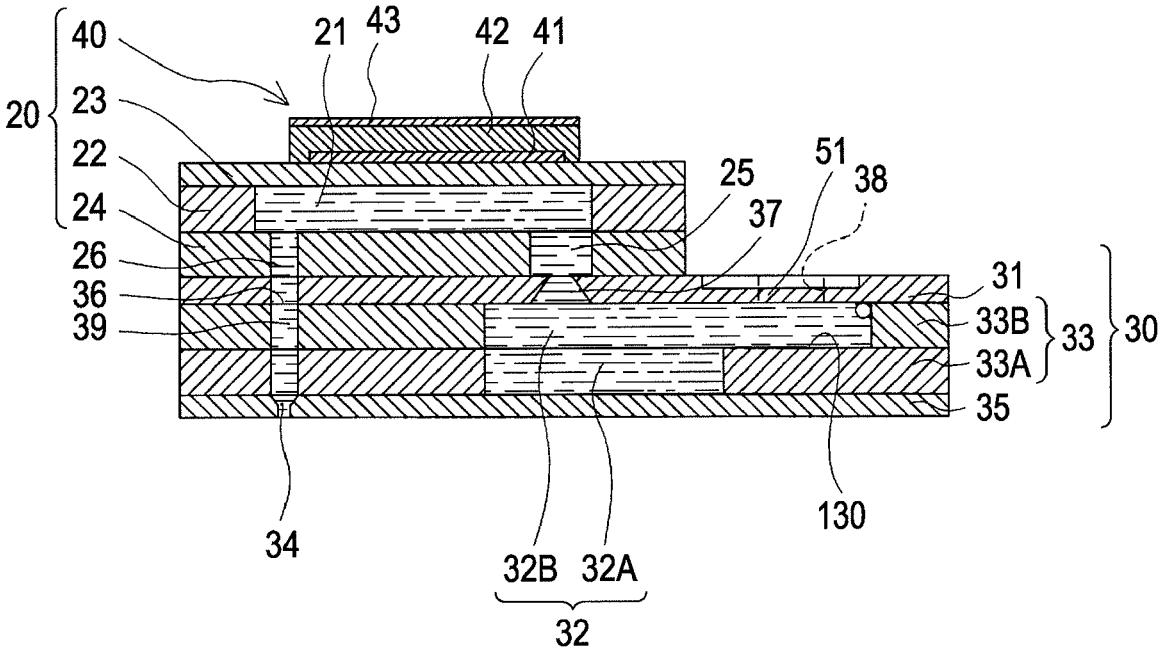
FIG. 7 is a cross-sectional view illustrating main part of a recording head according to a comparative example.

Incidentally, as shown in FIG. 7, it is also considered that the compliance portion 51 is disposed at the upper side of the reservoir forming substrate 33 in the vertical direction by changing the positions of the first reservoir 32A and the second reservoir 32B in the vertical direction. However, the speed of the ink which flows through the width increased portion 130 of the second reservoir 32B disposed at the upper side in the vertical direction is lowered and therefore the bubbles are likely to stay inside the width increased portion 130. Therefore, the ink discharge characteristic comes to deteriorate for the reason that the bubbles stay inside the ink channel and grow with the time, and thus the bubbles which has grown to a large size interrupt the flow of ink, or the pressure gives a shock to the bubbles when causing the pressure change to the pressure generating chamber 21 by the piezoelectric element 40 as the bubbles which has grown to a large size is introduced into the pressure generating chamber 21.

The reservoir forming substrate 33 is formed by bonding a first reservoir forming substrate 33A, through which the first reservoir 32A penetrates in the thickness direction, to a second reservoir forming substrate 33B, through which the second reservoir 32B penetrates in the thickness direction. Since the reservoir forming substrate 33 is composed of the first reservoir forming substrates 33A and the second reservoir forming substrates 33B, it is possible to easily form the first reservoir 32A and the second reservoir 32B which have different aperture areas. Alternatively, the single reservoir forming substrate 33 may be provided with both of the first reservoir 32A and the second reservoir 32B. That is, the reservoir forming substrate 33 may be a single member. With the structure in which the reservoir forming substrate 33 is composed of a single member, it is possible to prevent the cost from increasing by reducing the number of parts. As a material of the reservoir forming substrate 33, metal, such as stainless steel, or ceramic can be used.

The reservoir 32 can be formed into a desired form by etching, performing press processing, or grinding the reservoir forming substrate 33.

A material of the compliance substrate 50 may be a metal, such as stainless steel, or a ceramic. The compliance substrate 50 may not be specifically limited but be a structure composed of a film-shaped elastic film and a support substrate a portion of which is penetrated in a thickness direction. For example, the compliance substrate 50 is composed of a film-shaped elastic film constituting the compliance portion 51 and a support substrate having a portion which is penetrated in the thickness direction.

The compliance substrate 50 is provided with a nozzle communication hole 52 which links the nozzle communication hole 39 formed penetrating through the reservoir forming substrate 33 in the thickness direction with the nozzle orifice 34. That is, the ink from the pressure generating substrate 21 is discharged from the nozzle orifice 34 via the nozzle communication holes 36, 39, and 52 provided in the liquid supply hole forming substrate 31, the reservoir forming substrate 33, and the compliance substrate 50, respectively.

The nozzle plate 35 is formed by puncturing the nozzle orifices 34 at the same pitch as the pressure generating chambers 21 with respect to a thin plate made of stainless steel.

The channel unit 30 is formed by fixing the liquid supply hole forming substrate 31, the reservoir forming substrate 33, the compliance substrate 50, and the nozzle plate 35 together by an adhesive or a thermal fusing film. The channel unit 30 and the actuator unit 20 are fixed together via an adhesive or a thermal fusing film.

In the ink-jet recording head 10 having the above-mentioned structure, the ink is introduced into the reservoir 32 from the ink cartridge (storage unit) via the liquid take-in hole 38, the ink channel extending from the reservoir 32 to the nozzle orifice 34 is filled with the ink, and the inside pressure of each of the pressure generating chambers 21 is increased by deflection deformation of the piezoelectric element 40 and the vibrating plate 23 by applying a voltage to each of the piezoelectric elements 40 corresponding to each of the pressure generating chambers 21 according to a recording signal output from a drive circuit (not shown), so that ink droplets are ejected from the nozzle orifices 34.

Another embodiment

Figure 8:
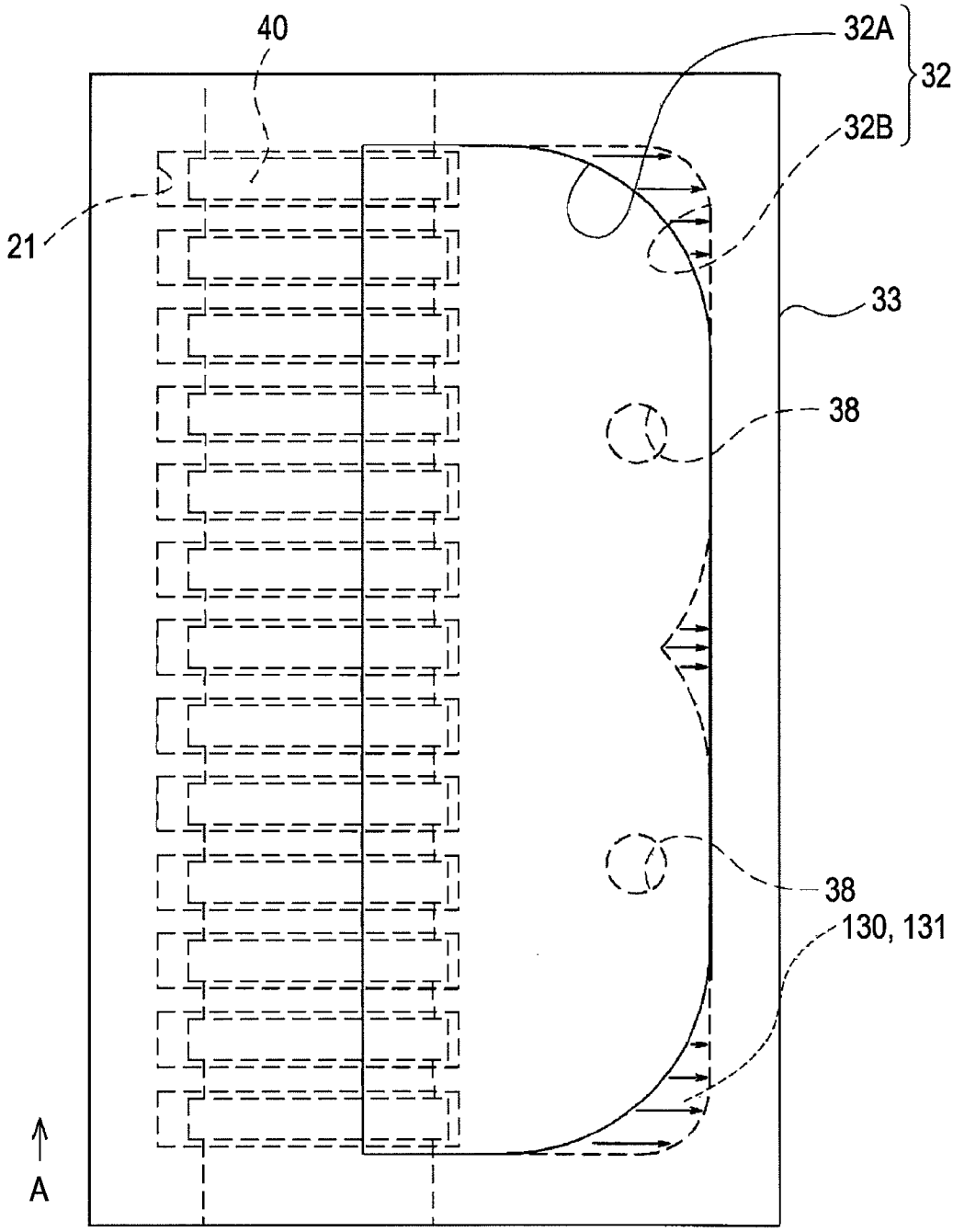
FIG. 8 is a plan view illustrating main part of a modification of a recording head according another embodiment of the invention.
Figure 9:
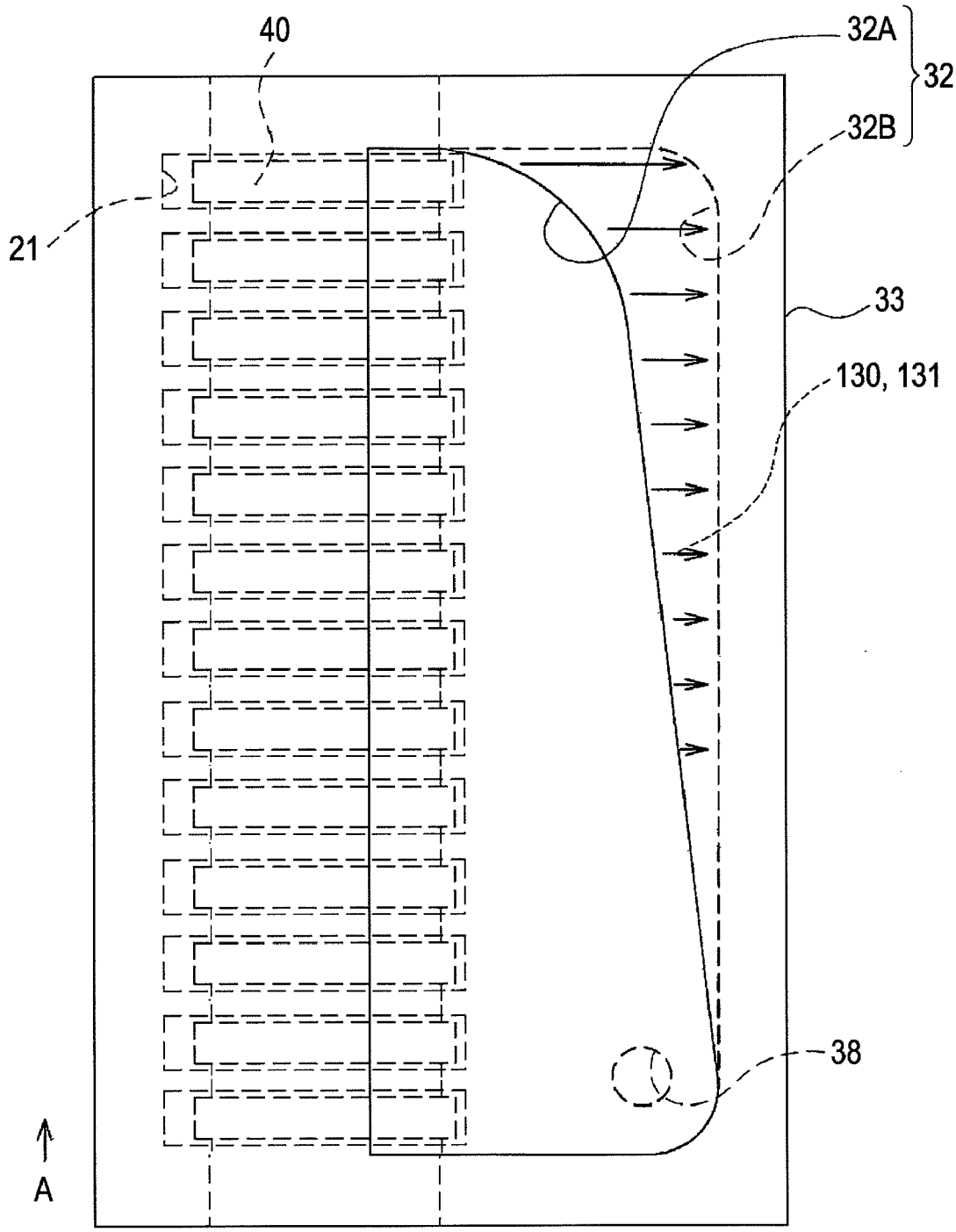
FIG. 9 is a plan view illustrating the main part of a modification of a recording head according to a further embodiment of the invention.

One embodiment of the invention is described above but the basic structure of the invention is not limited to the above description. For example, in the above-described first embodiment, although the liquid take-in hole 38 is disposed at the middle portion of the parallel arrangement direction (one direction) in which the pressure generating chambers 21 are arranged in parallel with one another, there may be a plurality of liquid take-in holes 38. In the later case, the first reservoir 32A may be structured in a manner such that the width of the reservoir in the direction which is perpendicular to the above-mentioned one direction gradually decreases toward a distal area which is distanced from an area communicating with the plurality of liquid take-in holes, and the inclined surface 131 which provides the width increased portion 130 may be disposed at an area which faces and has a shape corresponding to the gradually decreasing area of the first reservoir 32A. As shown in FIG. 8, in the case in which two liquid take-in holes are placed in one direction of the reservoir 32 with balance, the first reservoir 32A is provided in a manner such that the width of the first reservoir in the direction which is perpendicular to the above-mentioned one direction at both end sides of the above-mentioned one direction gradually decreases and the width in the direction which is perpendicular to a direction extending between the two liquid take-in holes gradually decreases. Furthermore, the second reservoir 32B may be provided with the inclined surfaces 131 which provide the width increasing portions 130 at three areas of the first reservoir 32A where the width gradually decreases. Further, as shown in FIG. 9, the liquid take-in hole 38 may be disposed at one end portion of the reservoir 32 in the above-mentioned one direction, and the gradually decreasing area and the inclined surface 131 of the second reservoir 32B may be disposed at the other end portion of the first reservoir 32A.

In the above-mentioned first embodiment, the inclined surface 131 is provided at the wall surface of the second reservoir 32B, i.e. at a lower portion of the reservoir 32 in the vertical direction, but the invention is not limited thereto. For example, the inclined surface may be formed across the thickness direction of the reservoir 32. That is, the wall surfaces of the first reservoir 32A and the second reservoir 32B may be a single inclined surface. The inclined surface 131 also may be closer to other areas, for example, to the liquid take-in hole 38.

In the first embodiment, the ink-jet recording head 10 having a thick film piezoelectric element 40 is exemplified, but the pressure generating unit which causes pressure change to the pressure generating chambers 21 are not limited to such a structure. For example, the same effect and advantage can be also achieved by a thin film piezoelectric element having a piezoelectric material layer formed through a sol-gel method, an MOD method, or a sputtering method, a vertical vibration type piezoelectric element in which piezoelectric material layers and electrode material layers are alternately laminated and which expands and contracts in an axis direction, an electrostatic actuator in which a vibrating plate and an electrode are placed with a predetermined gap therebetween and vibration of the vibrating plate is controlled by electrostatic force, and an ink-jet recording head in which a heater element is placed in a pressure generating chamber, and liquid droplets are discharged from a nozzle orifice by bubbles generated by heat from the heater element.

Figure 10:
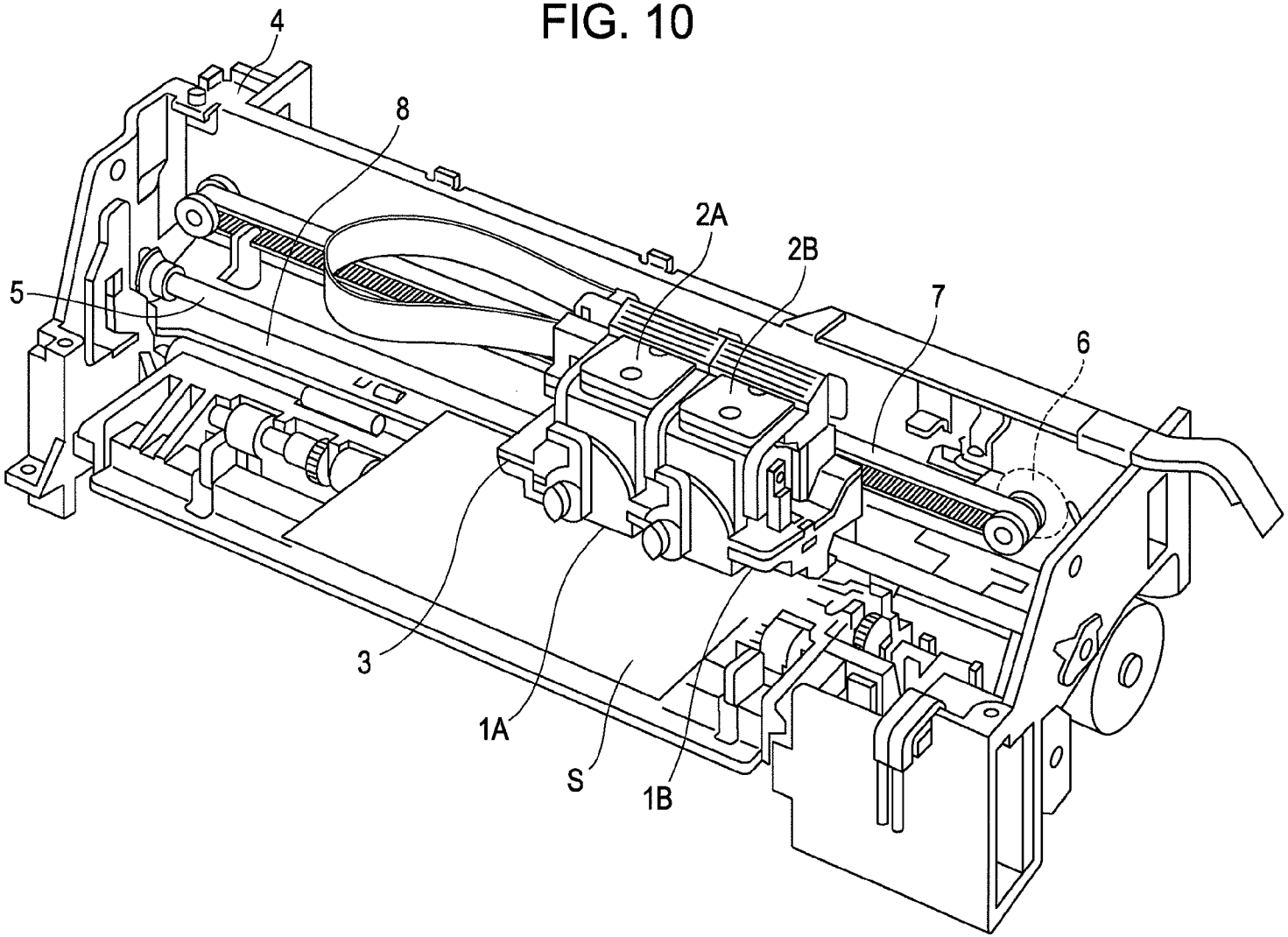
FIG. 10 is a schematic view illustrating an ink-jet recording head according to one embodiment of the invention.

The ink-jet recording head of this embodiment constitutes a portion of the recording head unit provided with ink channels communicating with ink cartridges and is mounted in an ink-jet recording device. FIG. 10 is a schematic view illustrating an example of the ink-jet recording device.

As shown in FIG. 10, the recording head units 1A and 1B which have the ink-jet recording heads are structured in a manner such that cartridges 2A and 2B which constitute ink supply units are detachably disposed. The carriage 3 in which the recording head units 1A and 1B are mounted is disposed engaging with a carriage shaft 5 attached to a device main body 4 in a freely movable manner in a shaft direction. The recording head units 1A and 1B discharge black ink composition and color ink composition, respectively.

The drive force of the drive motor 6 is transferred to the carriage 3 via a plurality of gears (not shown) and a timing belt 7 and therefore the carriage 3 which mounts the recording head units 1A and 1B therein is moved along the carriage shaft 5. On the other hand, a platen 8 is disposed in the device main body 4 along the carriage shaft 5, and a recording sheet S which is a recording medium, such as paper fed by a paper feeding roller (not shown) is wound around the platen 8 and is transported.

These drive motors 6 and pressure generating unit of the recording head units 1A and 1B are controlled by a control portion including a CPU and a memory which are not shown.

In the above embodiment, the ink-jet recording head is exemplified as the liquid ejecting head, but the invention relates to a wide range of liquid ejecting heads. That is, it is natural that the invention be applied to a testing method of the liquid ejecting head which ejects liquid other than the ink. As other liquid ejecting heads, there are various kinds of recording heads used in image recording devices, such as a printer, a color material ejecting head used in manufacturing of a color filter of a liquid crystal display, an electrode material ejecting head used in formation of electrodes of an organic EL display and a field emission display (FED), and a bioorganic compound ejecting head used in manufacturing of a bio chip.

The entire disclosure of Japanese Patent Application No. 2008-026908, filed Feb. 6, 2008 is incorporated by reference herein.

The entire disclosure of Japanese Patent Application No. 2008-249842, filed Sep. 9, 2008 is incorporated by reference herein.

What is claimed is:

1. A liquid ejecting head comprising:

a channel forming substrate in which a plurality of pressure generating chambers which communicate with nozzle orifices which eject liquid are arranged in a single direction;

a reservoir forming substrate provided with a reservoir serving as a common liquid chamber which communicates with the plurality of pressure generating chambers in a manner such that the reservoir is disposed over a way across the plurality of pressure generating chambers; and a pressure generating unit which causes pressure change to the plurality of pressure generating chambers, wherein at least a portion of a wall surface of the reservoir is an inclined surface, a lower side of the reservoir in a vertical direction is provided with a lower portion of which a width is wider than an upper portion of the reservoir in the vertical direction thanks to the inclined surface, a compliance portion which absorbs pressure of the reservoir is disposed at an area which faces the lower portion and has a shape corresponding to the lower portion, and the reservoir communicates with an upper portion of each of the pressure generating chambers in the vertical direction rather than a lower portion of each of pressure generating chambers.

2. The liquid ejecting head according to claim 1, wherein the inclined surface inclines toward a communicating side of each of the pressure generating chambers.

3. The liquid ejecting head according to claim 1, wherein the inclined surface is disposed at the lower side of the reservoir in the vertical direction and a vertical surface which directly and continuously extends from the inclined surface in the vertical direction is disposed at an upper side of the inclined surface in the vertical direction.

4. The liquid ejecting head according to claim 1, wherein a width of the upper portion of the reservoir in a direction which is perpendicular to the single direction and the vertical direction gradually decreases toward a distal portion from a liquid take-in portion of the reservoir at an area which is distanced in the single direction from an area which communicates with the liquid take-in portion through which liquid is introduced into the reservoir, and the inclined surface is disposed at least at an area of the reservoir which corresponds to a gradually decreasing area.

5. The liquid ejecting head according to claim 1, wherein the nozzle orifices are disposed on the same side as the reservoir with respect to the pressure generating chambers.

6. The liquid ejecting head according to claim 1, wherein the reservoir forming substrate is formed as a single member.

7. A liquid ejecting device comprising the liquid ejecting head according to claim 1.

* * * * *